US011396077B2

(12) United States Patent
Li et al.

(10) Patent No.: US 11,396,077 B2
(45) Date of Patent: Jul. 26, 2022

(54) WHEEL BURR CLEANING DEVICE

(71) Applicant: CITIC Dicastal Co., LTD, Qinhuangdao (CN)

(72) Inventors: Xueqiang Li, Qinhuangdao (CN); Bowen Xue, Qinhuangdao (CN); Jiandong Guo, Qinhuangdao (CN)

(73) Assignee: CITIC DICASTAL CO., LTD, Qinhuangdao (CN)

( * ) Notice: Subject to any disclaimer, the term of this patent is extended or adjusted under 35 U.S.C. 154(b) by 421 days.

(21) Appl. No.: 16/547,565

(22) Filed: Aug. 22, 2019

(65) Prior Publication Data

US 2020/0139501 A1 May 7, 2020

(30) Foreign Application Priority Data

Nov. 6, 2018 (CN) ..... 201811312712.1

(51) Int. Cl.

| | |
|---|---|
| ***B24B 5/44*** | (2006.01) |
| ***B24B 5/35*** | (2006.01) |
| ***B24B 41/06*** | (2012.01) |
| ***B24B 41/02*** | (2006.01) |

(52) U.S. Cl.

CPC ..... *B24B 5/44* (2013.01); *B24B 5/355* (2013.01); *B24B 41/02* (2013.01); *B24B 41/067* (2013.01)

(58) Field of Classification Search

CPC .. B24B 5/06; B24B 5/065; B24B 5/08; B24B 5/40; B24B 5/44; B24B 5/355; B24B 9/007; B24B 9/00; B24B 9/005; B24B 9/04; B24B 29/005; B24B 29/04; B24B 27/0076; B24B 27/0069; B24B 27/0023; B24B 19/00; B24B 41/067; B24B 41/061; B24B 41/065; B24B 41/066; B24B 41/005; B24B 41/06; B24B 47/12; B24B 55/00; B24D 13/145; A46B 2200/3093; A46B 13/008; B23Q 1/0054; B23Q 1/01; B23Q 1/012; B23Q 1/015; B23Q 1/25; B23Q 1/40; B23Q 1/46; B23Q 1/62; B60B 2310/00; B60B 2310/20; B60B 2310/60

USPC ..... 157/16, 18, 14, 21

See application file for complete search history.

(56) References Cited

U.S. PATENT DOCUMENTS

| | | | | |
|---|---|---|---|---|
| 10,213,890 | B2 * | 2/2019 | Xue | B24B 47/10 |
| 10,220,485 | B2 * | 3/2019 | Xue | B24B 29/005 |
| 10,814,452 | B2 * | 10/2020 | Xue | B24B 9/00 |
| 10,926,371 | B2 * | 2/2021 | Xu | B24B 5/08 |
| 2016/0354891 | A1 * | 12/2016 | Xue | B24B 47/12 |
| 2019/0321931 | A1 * | 10/2019 | Xue | B24B 27/0076 |

* cited by examiner

*Primary Examiner* — Tyrone V Hall, Jr.
*Assistant Examiner* — Makena S Markman
(74) *Attorney, Agent, or Firm* — Yong Chen

(57) ABSTRACT

A wheel burr cleaning device comprises a lower turnover system, a lower turnover system, a center hole burr brushing system, a back cavity burr brushing system, an upper lifting rotation system. The present disclosure not only can be used for removing burrs from the center hole of the wheel, the roots of the flanges and the edge of each spoke, but also can adapt to the wheels of different sizes and different widths.

1 Claim, 4 Drawing Sheets

WHEEL BURR CLEANING DEVICE

CROSS-REFERENCE TO RELATED APPLICATIONS

The present application claims the priority of Chinese patent application No. 201811312712.1, filed on Nov. 6, 2018, which is hereby incorporated by reference in its entirety.

TECHNICAL FIELD

The present disclosure relates to a burr cleaning device, and specifically relates to a wheel burr cleaning device.

BACKGROUND

In machining of an aluminum alloy wheel, due to the machining process and tools, burrs are inevitably produced in the center hole of the wheel, the roots of back cavity flanges and the edge of each spoke. If these burrs are not removed in time, the subsequent coating effect will be seriously affected. Due to the limitation of the structure, the postures of brushes need to be adjusted for different treated parts to remove the burrs there more effectively. At the same time, since general wheel manufacturers adopt mixed-line production, that is, wheels of different sizes and different widths are simultaneously circulated on the production line, a device is needed to ensure the burr removing effect while being able to adapt to the mixed line production.

SUMMARY

The present disclosure is directed to provide a wheel burr cleaning device, which not only can be used for removing burrs from the center hole of a wheel, the roots of flanges and the edge of each spoke, but also can adapt to wheels of different sizes and different widths.

In order to achieve the above objective, the technical solution of the present disclosure is, wheel burr cleaning device, is composed of a frame, lower guide pillars, lower guide sleeves, a pulley I, a lower fixed plate, a lower shaft I, a lower bearing block I, a lower lifting plate I, annular guide rails, lower rotating plates, lower racks I, lower gears I, lower guide rails I, lower bottom plates, lower servo motors I, lower vertical plates, upper bottom plates, swivels, gear rings, lower top plates, fixed lugs, lower servo motors II, lower turnover racks, lower servo motors III, lower fixed racks, lower servo motors IV, lower shafts II, lower bearing blocks II, lower servo motors V, lower rotating plates, lower brush wheels I, belt brushes, lower bearing blocks III, lower shafts III, lower brush wheels II, lower gears II, lower servo motors VI, a pulley II, a lower shaft IV, a lower bearing block IV, a lower flange, an anti-rotation pin, a lower bearing block V, a lower shaft V, a pulley III, a lower shaft VI, a lower bearing block VI, a pulley IV, a spline shaft, a rotary joint, a lower cylinder I, an upper flange, a lower guide rail II, a lower sliding plate, a lower rack II, a lower gear III, a lower guide rail III, a lower lifting plate II, a lower shaft VII, a lower bearing block VII, a center brush, a lower servo motor VII, a lower servo motor VIII, a servo electric cylinder, a lower shaft VIII, a lower bearing block VIII, a support block, a synchronous belt I, a pulley V, a synchronous belt II, lower cylinders II, clamping jaws, an upper gear, upper racks, an upper cylinder I, upper guide rails, a left sliding plate, an upper fixed plate, an upper shaft, an upper bearing block, an upper lifting plate, an upper servo motor, upper guide pillars, upper cylinders II, upper guide sleeves, a right sliding plate, a synchronous belt III, a lower servo motor IX, a pulley VI and a right flange.

A lower lifting system comprises: the four lower guide sleeves are fixed below a lower fixed plate, and the four lower guide pillars matching with the lower guide sleeves are fixed below the lower lifting plate I; the two lower cylinders II are also fixed below the lower fixed plate, and their output ends are articulated with the lower side of the lower lifting plate I.

A lower turnover system comprises: the lower bearing block VI is fixed at an intermediate position above the lower lifting plate I; the lower shaft VI is mounted inside the lower bearing block VI through a bearing; the pulley IV is fixed to the top end of the lower shaft VI; the inner side of the lower shaft VI cooperates with the outer side of the spline shaft; the upper flange is fixed at an intermediate position above the lower lifting plate I; the lower cylinder I is fixed below the top end of the upper flange; the top end of the lower cylinder I is connected to the upper side of the rotary joint; the top end of the spline shaft is connected to the lower side of the rotary joint; the right flange is fixed to the top end of the lower lifting plate I and placed on one side of the lower bearing block VI; the lower servo motor IX is fixed above the top end of the right flange; the pulley VI is fixed to the output end of the lower servo motor IX; the pulley IV and the pulley VI are connected by the synchronous belt III; the lower flange is fixed at an intermediate position below the lower lifting plate I; the lower bearing block V is fixed above the lower flange; the lower shaft V is mounted inside the lower bearing block V through a bearing; the pulley III is fixed to the top end of the lower shaft V; the lower bearing block IV is fixed below the lower flange; the lower shaft IV is mounted inside the lower bearing block IV through a bearing; the pulley II is fixed below the lower shaft IV; the interior of the lower shaft V is hollow, and the hollow diameter is larger than the diameter of the lower end of the spline shaft; the anti-rotation pin is fixed to the lower end the spline shaft; the top end of the lower shaft IV and the lower end of the lower shaft V are respectively provided with an open slot to cooperate with the anti-rotation pin; the lower bearing block I is fixed to the left side of the lower lifting plate I; the lower shaft I is mounted inside the lower bearing block I through a bearing; the pulley I is fixed below the lower shaft I; the top end of the lower shaft I is connected to the lower rotating plate; the pulley I and the pulley II are connected by the synchronous belt II; the lower bearing block VIII is fixed to the right side of the lower lifting plate I; the lower shaft VIII is mounted inside the lower bearing block VIII through a bearing; the pulley V is fixed below the lower shaft VIII; the pulley III and the pulley V are connected by the synchronous belt I; the annular guide rail is fixed above the lower lifting plate I; the support block is mounted between the annular guide rail and the lower rotating plate.

A center hole burr brushing system comprises: the lower sliding plate is mounted at the top end of the upper flange through the lower guide rail II; the lower rack II is fixed to the right side of a vertical plate of the lower sliding plate; the lower lifting plate II is mounted on the right side of the vertical plate of the lower sliding plate Via the lower guide rail III; the lower servo motor VIII is fixed to the lower lifting plate II, and the lower gear III is mounted at its output end; the lower gear III meshes with the lower rack II; the servo electric cylinder is fixed on the lower sliding plate, and its output end is connected to the top end of the upper flange; the lower bearing block VII is fixed above a top plate of the lower lifting plate II; the lower shaft VII is mounted inside the lower bearing block VII through a bearing; the center brush is fixed to the top end of the lower shaft VII; the lower servo motor VII is fixed below the top plate of the lower lifting plate II, and its output end is connected to the lower side of the lower shaft VII.

A back cavity burr brushing system comprises: the lower rack I is fixed above the lower rotating plate; the lower bottom plate is mounted above the lower rotating plate through the lower guide rail I; the lower servo motor I is fixed above the lower bottom plate; the lower gear I is fixed to the output end of the lower servo motor I; the lower gear I meshes with the lower rack I; the upper bottom plate is fixed to the top end of the lower bottom plate through the lower vertical plate; an outer ring of the swivel is mounted above the upper bottom plate; the lower top plate is fixed above an inner ring of the swivel; the gear ring is fixed inside the inner ring of the swivel; the lower servo motor VI is fixed below the upper bottom plate, and the lower gear II is fixed to its output end; the lower gear II meshes with the inner side of the gear ring; the fixed lug is fixed to the top end of the lower top plate; the lower turnover rack is mounted inside the fixed lug; the lower servo motor II is fixed to the side of the fixed lug, and its output end is connected to the lower side of the lower turnover rack; the lower side of the lower fixed rack is mounted inside the upper side of the lower turnover rack; the lower servo motor III is fixed to the side of the upper side of the lower turnover rack, and its output end is connected to the lower fixed rack; the lower bearing block II is fixed to the right side of the upper side of the lower fixed rack; the lower shaft II is mounted inside the lower bearing block II through a bearing; the lower servo motor IV is fixed to the left side of the lower fixed rack, and its output end is connected to the left side of the lower shaft II; the lower rotating plate is fixed to the right side of the lower shaft II; the lower servo motor V is fixed to the left side of the lower rotating plate, and the lower brush wheel I is fixed to its output end; the lower bearing block III is fixed to the left side of the lower rotating plate; the lower shaft III is mounted inside the lower bearing block III through a bearing; the lower brush wheel II is fixed to the right side of the lower shaft III; the lower brush wheel I and the lower brush wheel II are connected by the belt brush; the right sides of the lower brush wheel I and the lower brush wheel II are provided with bristles; this device comprises two symmetrical back cavity burr brushing systems.

An upper lifting rotation system comprises: the four upper guide sleeves are fixed to the top end of the frame; the four upper guide pillars matching with the upper guide sleeves are fixed above the upper lifting plates; the two upper cylinders II are also fixed to the top end of the frame, and their output ends are articulated to the upper side of the upper lifting plate; the upper bearing block is fixed at a center position below the upper lifting plate; the upper shaft is mounted inside the upper bearing block through a bearing; the upper servo motor is fixed above the upper lifting plate, and its output end is connected to the top end of the upper shaft; the upper fixed plate is fixed below the upper shaft; the left sliding plate and the right sliding plate are mounted at two ends below the upper fixed plate through the upper guide rails; the upper gear is fixed at a center position below the upper fixed plate; an upper rack is respectively fixed to the left sliding plate and the right sliding plate, and the two upper racks mesh with the upper gear; the upper cylinder I is fixed below the upper fixed plate, and its output end is connected to the left sliding plate; a clamping jaw is respectively fixed below the left sliding plate and the right sliding plate.

During operation, the upper cylinder I drives the clamping jaws to clamp a wheel through the upper racks, the upper gear and the upper guide rails; the upper cylinders II lift the wheel to a certain height through the upper guide pillars and the upper guide sleeves; the upper servo motor drives the clamped wheel to rotate through the upper shaft; the lower cylinders II lift the lower turnover system, the center hole burr brushing system and the back cavity burr brushing systems to certain heights through the lower guide pillars and the lower guide sleeves; the servo motor VII drives the center brush to rotate through the lower shaft VII; the lower servo motor VIII can precisely adjust the height of the center brush through the lower gear III, the lower rack II and the lower guide rail III, so that the center brush extends into the center hole of the rotating wheel; the servo electric cylinder can drive the rotating center brush to move through the lower guide rail II, and when the center brush contacts the center hole of the rotating wheel, the center brush can remove burrs there.

The lower servo motor IX drives the lower shaft VI and the spline shaft to rotate through the pulley VI, the pulley IV and the synchronous belt III; when a cylinder rod of the lower cylinder I contracts and the anti-rotation pin cooperates with the open slot at the lower end of the lower shaft V, the spline shaft can drive the lower shaft V and the pulley III to rotate; the pulley III drives the pulley V to rotate through the synchronous belt I, so as to drive the lower shaft VIII and the right back cavity burr brushing system to adjust the angles; when the cylinder rod of the lower cylinder I stretches out and the anti-rotation pin cooperates with the open slot at the top end of the lower shaft IV, the spline shaft can drive the lower shaft IV and the pulley II to rotate; the pulley II drives the pulley I to rotate through the synchronous belt II, so as to drive the lower shaft I and the left back cavity burr brushing system to adjust the angles.

The lower servo motor V drives the lower brush wheel I to rotate, and the belt brush also drives the lower brush wheel II to rotate; the lower servo motor IV can adjust the rotation angles of the lower brush wheel I and the lower brush wheel II in the vertical direction through the lower shaft II and the lower rotating plate; the lower servo motor III can adjust the front and rear angles of the lower brush wheel I and the lower brush wheel II; the lower servo motor II can adjust the left and right angles of the lower brush wheel I and the lower brush wheel II; the lower servo motor VI can adjust the rotation angles of the lower brush wheel I and the lower brush wheel II in the horizontal direction through the lower gear II, the gear ring and the swivel; the lower servo motor I can adjust the positions of the lower brush wheel I and the lower brush wheel II in the horizontal direction through the lower gear I, the lower racks I and the lower guide rail I.

When burrs at corners of wheel flange roots are removed, the lower servo motors IV adjust the lower brush wheels I and the lower brush wheels II to a horizontal state through the lower shafts II, and the lower cylinders II lift the left and right sets of lower brush wheels I and lower brush wheels II through the lower guide pillars and the lower guide sleeves, and when the left and right rotating belt brushes contact the corners of the wheel flange roots, the burrs there can be removed; when burrs at the edges of wheel spokes are removed, the lower servo motors IV adjust the lower brush wheels I and the lower brush wheels II to a vertical state through the lower shafts II, and the lower servo motors I, the lower servo motors II, the lower servo motors III and the lower servo motors VI adjust the lower brush wheels I and the lower brush wheels II to proper positions and angles; the lower cylinders II lift the left and right sets of lower brush wheels I and lower brush wheels II through the lower guide pillars and the lower guide sleeves, and the upper servo motor drives the wheel to rotate, so that the burrs at the edges of the respective spokes of the wheel can be removed.

The wheel burr cleaning device not only can be used for removing burrs from the center hole of the wheel, the roots of the flanges and the edge of each spoke, but also can adapt to the wheels of different sizes and different widths.

DETAILED DESCRIPTION

Figure 1:
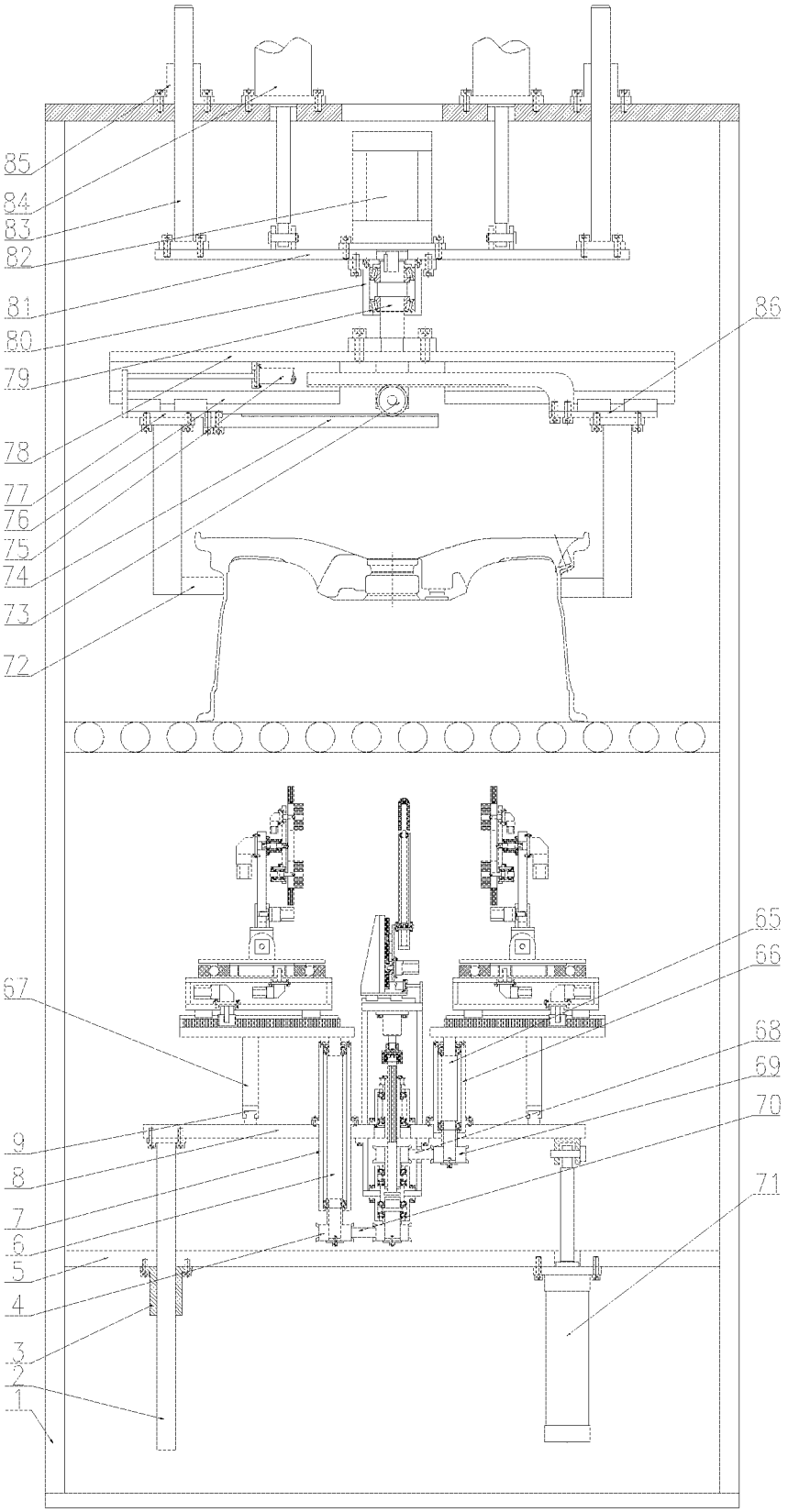
FIG. 1 is a front view of a wheel burr cleaning device according to the present disclosure.
Figure 2:
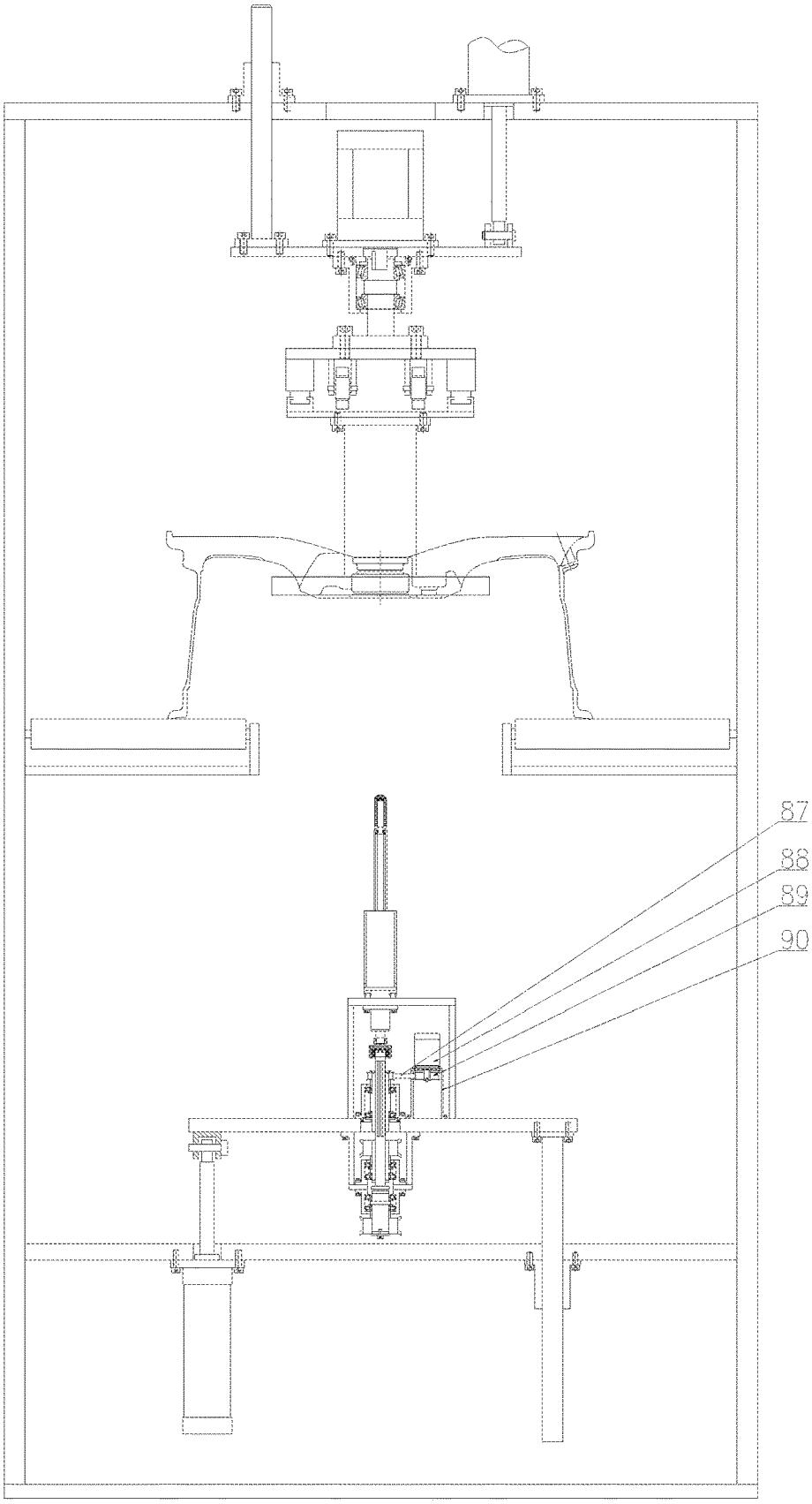
FIG. 2 is a partial left view of wheel burr cleaning device.
Figure 3:
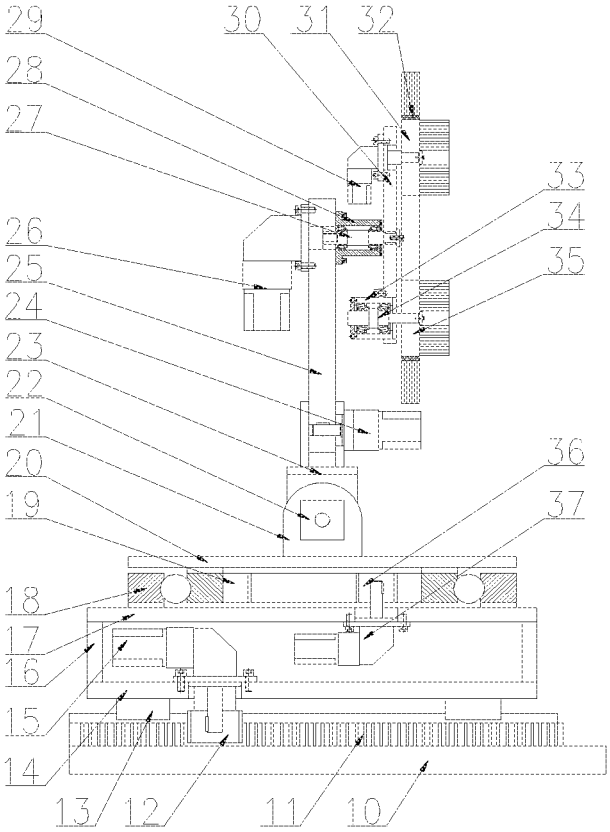
FIG. 3 is a front view of a back cavity burr brushing system of wheel burr cleaning device.
Figure 4:
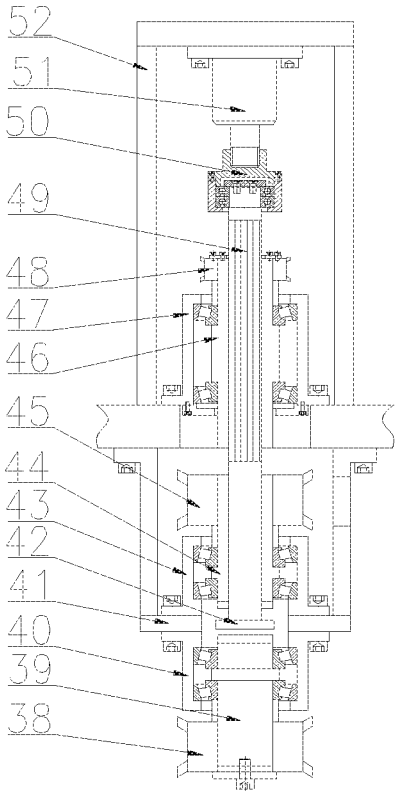
FIG. 4 is a partial front view of a lower turnover system of wheel burr cleaning device.
Figure 5:
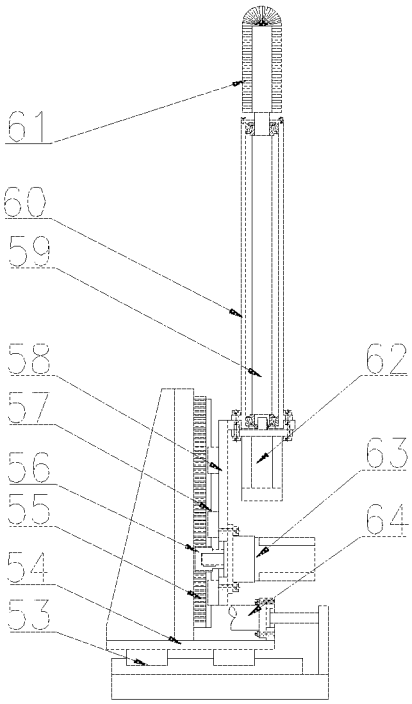
FIG. 5 is a front view of a center hole burr brushing system of wheel burr cleaning device.

The details and working conditions of the specific device according to the present disclosure will be described below in combination with the drawings.

The device is composed of a frame 1, lower guide pillars 2, lower guide sleeves 3, a pulley I 4, a lower fixed plate 5, a lower shaft I 6, a lower bearing block I 7, a lower lifting plate I 8, annular guide rails 9, lower rotating plates I 10, lower racks I 11, lower gears I 12, lower guide rails I 13, lower bottom plates 14, lower servo motors I 15, lower vertical plates 16, upper bottom plates 17, swivels 18, gear rings 19, lower top plates 20, fixed lugs 21, lower servo motors II 22, lower turnover racks 23, lower servo motors III 24, lower fixed racks 25, lower servo motors IV 26, lower shafts II 27, lower bearing blocks II 28, lower servo motors V 29, lower rotating plates II 30, lower brush wheels I 31, belt brushes 32, lower bearing blocks III 33, lower shafts III 34, lower brush wheels II 35, lower gears II 36, lower servo motors VI 37, a pulley II 38, a lower shaft IV 39, a lower bearing block IV 40, a lower flange 41, an anti-rotation pin 42, a lower bearing block V 43, a lower shaft V 44, a pulley III 45, a lower shaft VI 46, a lower bearing block VI 47, a pulley IV 48, a spline shaft 49, a rotary joint 50, a lower cylinder I 51, an upper flange 52, a lower guide rail II 53, a lower sliding plate 54, a lower rack II 55, a lower gear III 56, a lower guide rail III 57, a lower lifting plate II 58, a lower shaft VII 59, a lower bearing block VII 60, a center brush 61, a lower servo motor VII 62, a lower servo motor VIII 63, a servo electric cylinder 64, a lower shaft VIII 65, a lower bearing block VIII 66, a support block 67, a synchronous belt I 68, a pulley V 69, a synchronous belt II 70, lower cylinders II 71, clamping jaws 72, an upper gear 73, upper racks 74, an upper cylinder I 75, upper guide rails 76, a left sliding plate 77, an upper fixed plate 78, an upper shaft 79, an upper bearing block 80, an upper lifting plate 81, an upper servo motor 82, upper guide pillars 83, upper cylinders II 84, upper guide sleeves 85, a right sliding plate 86, a synchronous belt III 87, a lower servo motor IX 88, a pulley VI 89 and a right flange 90.

A lower lifting system comprises: the four lower guide sleeves 3 are fixed below a lower fixed plate 5, and the four lower guide pillars 2 matching with the lower guide sleeves 3 are fixed below the lower lifting plate I 8; the two lower cylinders II 71 are also fixed below the lower fixed plate 5, and their output ends are articulated with the lower side of the lower lifting plate I 8.

A lower turnover system comprises: the lower bearing block VI 47 is fixed at an intermediate position above the lower lifting plate I 8; the lower shaft VI 46 is mounted inside the lower bearing block VI 47 through a bearing; the pulley IV 48 is fixed to the top end of the lower shaft VI 46; the inner side of the lower shaft VI 46 cooperates with the outer side of the spline shaft 49; the upper flange 52 is fixed at an intermediate position above the lower lifting plate I 8; the lower cylinder I 51 is fixed below the top end of the upper flange 52; the top end of the lower cylinder I 51 is connected to the upper side of the rotary joint 50; the top end of the spline shaft 49 is connected to the lower side of the rotary joint 50; the right flange 90 is fixed to the top end of the lower lifting plate I 8 and placed on one side of the lower bearing block VI 47; the lower servo motor IX 88 is fixed above the top end of the right flange 90; the pulley VI 89 is fixed to the output end of the lower servo motor IX 88; the pulley IV 48 and the pulley VI 89 are connected by the synchronous belt III 87; the lower flange 41 is fixed at an intermediate position below the lower lifting plate I 8; the lower bearing block V 43 is fixed above the lower flange 41; the lower shaft V 44 is mounted inside the lower bearing block V 43 through a bearing; the pulley III 45 is fixed to the top end of the lower shaft V 44; the lower bearing block IV 40 is fixed below the lower flange 41; the lower shaft IV 39 is mounted inside the lower bearing block IV 40 through a bearing; the pulley II 38 is fixed below the lower shaft IV 39; the interior of the lower shaft V 44 is hollow, and the hollow diameter is larger than the diameter of the lower end of the spline shaft 49; the anti-rotation pin 42 is fixed to the lower end the spline shaft 49; the top end of the lower shaft IV 39 and the lower end of the lower shaft V 44 are respectively provided with an open slot to cooperate with the anti-rotation pin 42; the lower bearing block I 7 is fixed to the left side of the lower lifting plate I 8; the lower shaft I 6 is mounted inside the lower bearing block I 7 through a bearing; the pulley I 4 is fixed below the lower shaft I 6; the top end of the lower shaft I 6 is connected to the lower rotating plate I 10; the pulley I 4 and the pulley II 38 are connected by the synchronous belt II 70; the lower bearing block VIII 66 is fixed to the right side of the lower lifting plate I 8; the lower shaft VIII 65 is mounted inside the lower bearing block VIII 66 through a bearing; the pulley V 69 is fixed below the lower shaft VIII 65; the pulley III 45 and the pulley V 69 are connected by the synchronous belt I 68; the annular guide rail 9 is fixed above the lower lifting plate I 8; the support block 67 is mounted between the annular guide rail 9 and the lower rotating plate I 10.

A center hole burr brushing system comprises: the lower sliding plate 54 is mounted at the top end of the upper flange 52 through the lower guide rail II 53; the lower rack II 55 is fixed to the right side of a vertical plate of the lower sliding plate 54; the lower lifting plate II 58 is mounted on the right side of the vertical plate of the lower sliding plate 54 Via the lower guide rail 11157; the lower servo motor VIII 63 is fixed to the lower lifting plate II 58, and the lower gear III 56 is mounted at its output end; the lower gear III 56 meshes with the lower rack II 55; the servo electric cylinder 64 is fixed on the lower sliding plate 54, and its output end is connected to the top end of the upper flange 52; the lower bearing block VII 60 is fixed above a top plate of the lower lifting plate II 58; the lower shaft VII 59 is mounted inside the lower bearing block VII 60 through a bearing; the center brush 61 is fixed to the top end of the lower shaft VII 59; the lower servo motor VII 62 is fixed below the top plate of the lower lifting plate II 58, and its output end is connected to the lower side of the lower shaft VII 59.

A back cavity burr brushing system comprises: the lower rack I 11 is fixed above the lower rotating plate I 10; the lower bottom plate 14 is mounted above the lower rotating plate I 10 through the lower guide rail I 13; the lower servo motor I 15 is fixed above the lower bottom plate 14; the lower gear I 12 is fixed to the output end of the lower servo motor I 15; the lower gear I 12 meshes with the lower rack I 11; the upper bottom plate 17 is fixed to the top end of the lower bottom plate 14 through the lower vertical plate 16; an outer ring of the swivel 18 is mounted above the upper bottom plate 17; the lower top plate 20 is fixed above an inner ring of the swivel 18; the gear ring 19 is fixed inside the inner ring of the swivel 18; the lower servo motor VI 37 is fixed below the upper bottom plate 17, and the lower gear II 36 is fixed to its output end; the lower gear II 36 meshes with the inner side of the gear ring 19; the fixed lug 21 is fixed to the top end of the lower top plate 20; the lower turnover rack 23 is mounted inside the fixed lug 21; the lower servo motor II 22 is fixed to the side of the fixed lug 21, and its output end is connected to the lower side of the lower turnover rack 23; the lower side of the lower fixed rack 25 is mounted inside the upper side of the lower turnover rack 23; the lower servo motor III 24 is fixed to the side of the upper side of the lower turnover rack 23, and its output end is connected to the lower fixed rack 25; the lower bearing block II 28 is fixed to the right side of the upper side of the lower fixed rack 25; the lower shaft II 27 is mounted inside the lower bearing block II 28 through a bearing; the lower servo motor IV 26 is fixed to the left side of the lower fixed rack 25, and its output end is connected to the left side of the lower shaft II 27; the lower rotating plate II 30 is fixed to the right side of the lower shaft II 27; the lower servo motor V 29 is fixed to the left side of the lower rotating plate II 30, and the lower brush wheel I 31 is fixed to its output end; the lower bearing block III 33 is fixed to the left side of the lower rotating plate II 30; the lower shaft III 34 is mounted inside the lower bearing block III 33 through a bearing; the lower brush wheel II 35 is fixed to the right side of the lower shaft III 34; the lower brush wheel I 31 and the lower brush wheel II 35 are connected by the belt brush 32; the right sides of the lower brush wheel I 31 and the lower brush wheel II 35 are provided with bristles; this device comprises two symmetrical back cavity burr brushing systems.

An upper lifting rotation system comprises: the four upper guide sleeves 85 are fixed to the top end of the frame 1; the four upper guide pillars 83 matching with the upper guide sleeves 85 are fixed above the upper lifting plates 81; the two upper cylinders II 84 are also fixed to the top end of the frame 1, and their output ends are articulated to the upper side of the upper lifting plate 81; the upper bearing block 80 is fixed at a center position below the upper lifting plate 81; the upper shaft 79 is mounted inside the upper bearing block 80 through a bearing; the upper servo motor 82 is fixed above the upper lifting plate 81, and its output end is connected to the top end of the upper shaft 79; the upper fixed plate 78 is fixed below the upper shaft 79; the left sliding plate 77 and the right sliding plate 86 are mounted at two ends below the upper fixed plate 78 through the upper guide rails 76; the upper gear 73 is fixed at a center position below the upper fixed plate 78; an upper rack 74 is respectively fixed to the left sliding plate 77 and the right sliding plate 86, and the two upper racks 74 mesh with the upper gear 73; the upper cylinder I 75 is fixed below the upper fixed plate 78, and its output end is connected to the left sliding plate 77; a clamping jaw 72 is respectively fixed below the left sliding plate 77 and the right sliding plate 86.

During operation, the upper cylinder I 75 drives the clamping jaws 72 to clamp a wheel through the upper racks 74, the upper gear 73 and the upper guide rails 76; the upper cylinders II 84 lift the wheel to a certain height through the upper guide pillars 83 and the upper guide sleeves 85; the upper servo motor 82 drives the clamped wheel to rotate through the upper shaft 79; the lower cylinders II 71 lift the lower turnover system, the center hole burr brushing system and the back cavity burr brushing systems to certain heights through the lower guide pillars 2 and the lower guide sleeves 3; the servo motor VII 62 drives the center brush 61 to rotate through the lower shaft VII 59; the lower servo motor VIII 63 can precisely adjust the height of the center brush 61 through the lower gear III 56, the lower rack II 55 and the lower guide rail III 57, so that the center brush 61 extends into the center hole of the rotating wheel; the servo electric cylinder 64 can drive the rotating center brush 61 to move through the lower guide rail II 53, and when the center brush 61 contacts the center hole of the rotating wheel, the center brush 61 can remove burrs there.

The lower servo motor IX 88 drives the lower shaft VI 46 and the spline shaft 49 to rotate through the pulley VI 89, the pulley IV 48 and the synchronous belt III 87; when a cylinder rod of the lower cylinder I 51 contracts and the anti-rotation pin 42 cooperates with the open slot at the lower end of the lower shaft V 44, the spline shaft 49 can drive the lower shaft V 44 and the pulley III 45 to rotate; the pulley III 45 drives the pulley V 69 to rotate through the synchronous belt I 68, so as to drive the lower shaft VIII 65 and the right back cavity burr brushing system to adjust the angles; when the cylinder rod of the lower cylinder I 51 stretches out and the anti-rotation pin 42 cooperates with the open slot at the top end of the lower shaft IV 39, the spline shaft 49 can drive the lower shaft IV 39 and the pulley II 38 to rotate; the pulley II 38 drives the pulley I 4 to rotate through the synchronous belt II 70, so as to drive the lower shaft I 6 and the left back cavity burr brushing system to adjust the angles.

The lower servo motor V 29 drives the lower brush wheel I 31 to rotate, and the belt brush 32 also drives the lower brush wheel II 35 to rotate; the lower servo motor IV 26 can adjust the rotation angles of the lower brush wheel I 31 and the lower brush wheel II 35 in the vertical direction through the lower shaft II 27 and the lower rotating plate II 30; the lower servo motor III 24 can adjust the front and rear angles of the lower brush wheel I 31 and the lower brush wheel II 35; the lower servo motor II 22 can adjust the left and right angles of the lower brush wheel I 31 and the lower brush wheel II 35; the lower servo motor VI 37 can adjust the rotation angles of the lower brush wheel I 31 and the lower brush wheel II 35 in the horizontal direction through the lower gear II 36, the gear ring 19 and the swivel 18; the lower servo motor I 15 can adjust the positions of the lower brush wheel I 31 and the lower brush wheel II 35 in the horizontal direction through the lower gear I 12, the lower racks I 11 and the lower guide rail I 13.

When burrs at corners of wheel flange roots are removed, the lower servo motors IV 26 adjust the lower brush wheels I 31 and the lower brush wheels II 35 to a horizontal state through the lower shafts II 27, and the lower cylinders II 71 lift the left and right sets of lower brush wheels I 31 and lower brush wheels II 35 through the lower guide pillars 2 and the lower guide sleeves 3, and when the left and right rotating belt brushes 32 contact the corners of the wheel flange roots, the burrs there can be removed; when burrs at the edges of wheel spokes are removed, the lower servo motors IV 26 adjust the lower brush wheels I 31 and the lower brush wheels II 35 to a vertical state through the lower shafts II 27, and the lower servo motors I 15, the lower servo motors II 22, the lower servo motors III 24 and the lower servo motors VI 37 adjust the lower brush wheels I 31 and the lower brush wheels II 35 to proper positions and angles; the lower cylinders II 71 lift the left and right sets of lower brush wheels I 31 and lower brush wheels II 35 through the lower guide pillars 2 and the lower guide sleeves 3, and the upper servo motor 82 drives the wheel to rotate, so that the burrs at the edges of the respective spokes of the wheel can be removed.

What is claimed is:

1. A wheel burr cleaning device, comprising: a frame, four lower guide pillars, four lower guide sleeves, a pulley I, a lower fixed plate, a lower shaft I, a lower bearing block I, a lower lifting plate I, annular guide rails, lower rotating plates I, lower racks I, lower gears I, lower guide rails I, lower bottom plates, lower servo motors I, lower vertical plates, upper bottom plates, swivels, gear rings, lower top plates, fixed lugs, lower servo motors II, lower turnover racks, lower servo motors III, lower fixed racks, lower servo motors IV, lower shafts II, lower bearing blocks II, lower servo motors V, lower rotating plates II, lower brush wheels I, belt brushes, lower bearing blocks III, lower shafts III, lower brush wheels II, lower gears II, lower servo motors VI, a pulley II, a lower shaft IV, a lower bearing block IV, a lower flange, an anti-rotation pin, a lower bearing block V, a lower shaft V, a pulley III, a lower shaft VI, a lower bearing block VI, a pulley IV, a spline shaft, a rotary joint, a lower cylinder I, an upper flange, a lower guide rail II, a lower sliding plate, a lower rack II, a lower gear III, a lower guide rail III, a lower lifting plate II, a lower shaft VII, a lower bearing block VII, a center brush, a lower servo motor VII, a lower servo motor VIII, a servo electric cylinder, a lower shaft VIII, a lower bearing block VIII, a support block, a synchronous belt I, a pulley V, a synchronous belt II, two lower cylinders II, clamping jaws, an upper gear, upper racks, an upper cylinder I, upper guide rails, a left sliding plate, an upper fixed plate, an upper shaft, an upper bearing block, an upper lifting plate, an upper servo motor, four upper guide pillars, two upper cylinders II, four upper guide sleeves, a right sliding plate, a synchronous belt III, a lower servo motor IX, a pulley VI and a right flange; wherein:

a lower lifting system comprises: the four lower guide sleeves being fixed below the lower fixed plate, wherein the four lower guide pillars matching with the four lower guide sleeves are fixed below the lower lifting plate I; the two lower cylinders II being fixed below the lower fixed plate, wherein their output ends are articulated with the lower side of the lower lifting plate I;

a lower turnover system comprises: the lower bearing block VI being fixed at an intermediate position above the lower lifting plate I; the lower shaft VI being mounted inside the lower bearing block VI through a bearing; the pulley IV being fixed to the top end of the lower shaft VI; the inner side of the lower shaft VI cooperating with the outer side of the spline shaft; the upper flange being fixed at an intermediate position above the lower lifting plate I; the lower cylinder I being fixed below the top end of the upper flange, wherein the top end of the lower cylinder I is connected to the upper side of the rotary joint and the top end of the spline shaft is connected to the lower side of the rotary joint; the right flange being fixed to the top end of the lower lifting plate I and placed on one side of the lower bearing block VI; the lower servo motor IX being fixed above the top end of the right flange; the pulley VI being fixed to the output end of the lower servo motor IX; the pulley IV and the pulley VI being connected by the synchronous belt III; the lower flange being fixed at an intermediate position below the lower lifting plate I; the lower bearing block V being fixed above the lower flange; the lower shaft V being mounted inside the lower bearing block V through a bearing; the pulley III being fixed to the top end of the lower shaft V; the lower bearing block IV being fixed below the lower flange; the lower shaft IV being mounted inside the lower bearing block IV through a bearing; the pulley II being fixed below the lower shaft IV, wherein the interior of the lower shaft V is hollow, and the hollow diameter is larger than the diameter of the lower end of the spline shaft; the anti-rotation pin being fixed to the lower end the spline shaft; the top end of the lower shaft IV and the lower end of the lower shaft V being respectively provided with an open slot to cooperate with the anti-rotation pin; the lower bearing block I being fixed to the left side of the lower lifting plate I; the lower shaft I being mounted inside the lower bearing block I through a bearing; the pulley I being fixed below the lower shaft I, where the top end of the lower shaft I is connected to the lower rotating plate I and the pulley I and the pulley II are connected by the synchronous belt II; the lower bearing block VIII being fixed to the right side of the lower lifting plate I; the lower shaft VIII being mounted inside the lower bearing block VIII through a bearing; the pulley V being fixed below the lower shaft VIII, wherein the pulley III and the pulley V are connected by the synchronous belt I; the annular guide rail being fixed above the lower lifting plate I; the support block being mounted between the annular guide rail and the lower rotating plate I;

a center hole burr brushing system comprises: the lower sliding plate being mounted at the top end of the upper flange through the lower guide rail II; the lower rack II being fixed to the right side of a vertical plate of the lower sliding plate; the lower lifting plate II being mounted on the right side of the vertical plate of the lower sliding plate Via the lower guide rail III; the lower servo motor VIII being fixed to the lower lifting plate II, and the lower gear III being mounted at its output end, wherein the lower gear III meshes with the lower rack II; the servo electric cylinder being fixed on the lower sliding plate, wherein its output end is connected to the top end of the upper flange; the lower bearing block VII being fixed above a top plate of the lower lifting plate II; the lower shaft VII being mounted inside the lower bearing block VII through a bearing; the center brush being fixed to the top end of the lower shaft VII; the lower servo motor VII being fixed below the top plate of the lower lifting plate II, wherein its output end is connected to the lower side of the lower shaft VII;

a back cavity burr brushing system comprises: the lower rack I being fixed above the lower rotating plate I; the lower bottom plate being mounted above the lower rotating plate I through the lower guide rail I; the lower servo motor I being fixed above the lower bottom plate;

the lower gear I being fixed to the output end of the lower servo motor I; the lower gear I meshes with the lower rack I; the upper bottom plate being fixed to the top end of the lower bottom plate through the lower vertical plate; an outer ring of the swivel being mounted above the upper bottom plate; the lower top plate being fixed above an inner ring of the swivel; the gear ring being fixed inside the inner ring of the swivel; the lower servo motor VI being fixed below the upper bottom plate, and the lower gear II being fixed to its output end; the lower gear II meshes with the inner side of the gear ring; the fixed lug being fixed to the top end of the lower top plate; the lower turnover rack being mounted inside the fixed lug; the lower servo motor II being fixed to the side of the fixed lug, wherein its output end is connected to the lower side of the lower turnover rack; the lower side of the lower fixed rack being mounted inside the upper side of the lower turnover rack; the lower servo motor III being fixed to the side of the upper side of the lower turnover rack, wherein its output end is connected to the lower fixed rack; the lower bearing block II being fixed to the right side of the upper side of the lower fixed rack; the lower shaft II being mounted inside the lower bearing block II through a bearing; the lower servo motor IV being fixed to the left side of the lower fixed rack, wherein its output end is connected to the left side of the lower shaft II; the lower rotating plate II being fixed to the right side of the lower shaft II; the lower servo motor V being fixed to the left side of the lower rotating plate II, and the lower brush wheel I being fixed to its output end; the lower bearing block III being fixed to the left side of the lower rotating plate II; the lower shaft III being mounted inside the lower bearing block III through a bearing; the lower brush wheel II being fixed to the right side of the lower shaft III, wherein the lower brush wheel I and the lower brush wheel II are connected by the belt brush, the right sides of the lower brush wheel I and the lower brush wheel II are provided with bristles; this device comprises two symmetrical back cavity burr brushing systems;

an upper lifting rotation system comprises: the four upper guide sleeves being fixed to the top end of the frame; the four upper guide pillars matching with the four upper guide sleeves and being fixed above the upper lifting plates; the two upper cylinders II being fixed to the top end of the frame, wherein their output ends are articulated to the upper side of the upper lifting plate; the upper bearing block being fixed at a center position below the upper lifting plate; the upper shaft being mounted inside the upper bearing block through a bearing; the upper servo motor being fixed above the upper lifting plate, wherein its output end is connected to the top end of the upper shaft; the upper fixed plate being fixed below the upper shaft; the left sliding plate and the right sliding plate being mounted at two ends below the upper fixed plate through the upper guide rails; the upper gear being fixed at a center position below the upper fixed plate; an upper rack being respectively fixed to the left sliding plate and the right sliding plate, wherein the two upper racks mesh with the upper gear; the upper cylinder I being fixed below the upper fixed plate, wherein its output end is connected to the left sliding plate; a clamping jaw being fixed below the left sliding plate and the right sliding plate;

during operation, the upper cylinder I drives the clamping jaws to clamp a wheel through the upper racks, the upper gear and the upper guide rails; the two upper cylinders II lift the wheel to a certain height through the four upper guide pillars and the four upper guide sleeves; the upper servo motor drives the clamped wheel to rotate through the upper shaft; the two lower cylinders II lift the lower turnover system, the center hole burr brushing system and the back cavity burr brushing systems to certain heights through the four lower guide pillars and the four lower guide sleeves; the servo motor VII drives the center brush to rotate through the lower shaft VII; the lower servo motor VIII can precisely adjust the height of the center brush through the lower gear III, the lower rack II and the lower guide rail III, so that the center brush extends into the center hole of the rotating wheel; the servo electric cylinder can drive the rotating center brush to move through the lower guide rail II, and when the center brush contacts the center hole of the rotating wheel, the center brush can remove burrs thereof;

the lower servo motor IX drives the lower shaft VI and the spline shaft to rotate through the pulley VI, the pulley IV and the synchronous belt III; when a cylinder rod of the lower cylinder I contracts and the anti-rotation pin cooperates with the open slot at the lower end of the lower shaft V, the spline shaft can drive the lower shaft V and the pulley III to rotate; the pulley III drives the pulley V to rotate through the synchronous belt I, so as to drive the lower shaft VIII and the right back cavity burr brushing system to adjust the angles; when the cylinder rod of the lower cylinder I stretches out and the anti-rotation pin cooperates with the open slot at the top end of the lower shaft IV, the spline shaft can drive the lower shaft IV and the pulley II to rotate; the pulley II drives the pulley I to rotate through the synchronous belt II, so as to drive the lower shaft I and the left back cavity burr brushing system to adjust the angles;

the lower servo motor V drives the lower brush wheel I to rotate, and the belt brush also drives the lower brush wheel II to rotate; the lower servo motor IV can adjust the rotation angles of the lower brush wheel I and the lower brush wheel II in the vertical direction through the lower shaft II and the lower rotating plate II; the lower servo motor III can adjust the front and rear angles of the lower brush wheel I and the lower brush wheel II; the lower servo motor II can adjust the left and right angles of the lower brush wheel I and the lower brush wheel II; the lower servo motor VI can adjust the rotation angles of the lower brush wheel I and the lower brush wheel II in the horizontal direction through the lower gear II, the gear ring and the swivel; the lower servo motor I can adjust the positions of the lower brush wheel I and the lower brush wheel II in the horizontal direction through the lower gear I, the lower racks I and the lower guide rail I.

* * * * *